US007418944B2

(12) United States Patent
Akita et al.

(10) Patent No.: US 7,418,944 B2
(45) Date of Patent: Sep. 2, 2008

(54) ELECTRONIC THROTTLE CONTROL APPARATUS

(75) Inventors: Minoru Akita, Ama-gun (JP); Katsumi Ishida, Toyoake (JP); Tsutomu Miyazaki, Nishikamo-gun (JP); Shigeru Kamio, Nagoya (JP)

(73) Assignees: Aisan Kogyo Kabushiki Kaisha, Obu (JP); Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 0 days.

(21) Appl. No.: 11/905,088

(22) Filed: Sep. 27, 2007

(65) Prior Publication Data

US 2008/0083394 A1 Apr. 10, 2008

(30) Foreign Application Priority Data

Oct. 4, 2006 (JP) ..... 2006-272547
Oct. 4, 2006 (JP) ..... 2006-272549

(51) Int. Cl.
*F02D 45/00* (2006.01)
*F02D 9/02* (2006.01)

(52) U.S. Cl. ..... 123/399

(58) Field of Classification Search ..... 123/399, 123/361
See application file for complete search history.

(56) References Cited

U.S. PATENT DOCUMENTS 4,343,277 A * 8/1982 Ohnaka et al. ..... 123/396
6,874,468 B2 * 4/2005 Watanabe ..... 123/377
7,171,946 B1 * 2/2007 Watanabe ..... 123/399

FOREIGN PATENT DOCUMENTS

JP A 7-269406 10/1995
JP 2003-138971 A * 5/2003
JP A 2005-171915 6/2005

* cited by examiner

*Primary Examiner*—Hieu T Vo
(74) *Attorney, Agent, or Firm*—Oliff & Berridge, PLC

(57) ABSTRACT

An electronic throttle control apparatus includes: a motor; a throttle valve which is driven by the motor to open and close; a throttle sensor for detecting an actual opening angle of the throttle valve. This electronic throttle control apparatus is arranged to control an opening angle of the throttle valve by driving the motor so that the actual opening angle detected by the throttle sensor becomes a target opening angle, the apparatus further includes a fully closing stopper, and an abutting determination unit for determining whether the throttle valve abuts against the fully closing stopper. The abutting determination unit is arranged to determine whether the throttle valve abuts against the fully closing stopper based on a determination condition preset with respect to each one of a plurality of duty ratio ranges.

10 Claims, 9 Drawing Sheets

ELECTRONIC THROTTLE CONTROL APPARATUS

BACKGROUND OF THE INVENTION

1. Field of the Invention

The invention relates to an electronically controlled throttle apparatus for controlling intake air volume of an internal-combustion engine.

2. Description of the Related Art

A conventional electronic throttle control apparatus includes a throttle body forming an intake passage, a throttle valve for opening and closing the intake passage, a motor for driving the throttle valve, and a throttle sensor for detecting an actual opening angle of the throttle valve. Rotation of the motor is transmitted to the throttle valve by way of a reduction mechanism, driving (opening or closing) the throttle valve, and the actual opening angle of the throttle valve detected by the throttle sensor is so controlled as to be a target opening angle.

This kind of electronic throttle control apparatus, for example, learns a fully closed position of the throttle valve as a reference position, and controls the opening angle of the throttle valve, based on the learned fully closed position.

When the fully closed position is to be learned, abutting against the fully closing stopper is determined. To control the opening angle of throttle valve with a high degree of precision, therefore, a high-precision determination of abutting against the fully closing stopper is required. In the abutting determination, it is detected that the throttle valve has hit the fully closing stopper (the fully closed position) when a duty ratio has become larger than a predetermined threshold value. (JP2005-171915A)

The electronic throttle control apparatus is arranged to set a control opening lower limit which is larger than a control reference opening angle by a predetermined opening angle (for example, about 0.5 deg.), so that the opening angle of the throttle valve may not become smaller than this control opening lower limit.

Learning of the fully closed position is determined depending on the condition of an accelerator position or a battery voltage before an engine starts. For some reason, however, the fully closed position may not be learned before the engine starts. Accordingly, a new electronic throttle control apparatus has been proposed for learning the fully closed position not only before but also after start of the engine. In this electronic throttle control apparatus, when the throttle valve abuts against the fully closing stopper, this position is adopted to be learned and updated as the actual fully closed position (JP 7-269406(1995)A).

In the conventional throttle control apparatus, however, abutting of the throttle valve against the fully closing stopper may not be detected accurately. For example, when the material of gear units and others for composing a throttle system is a resin or the like, abutting against the fully closing stopper may not be detected accurately. That is, when the gear unit or the like is made of resin or the like, the amount of distortion or the dimension of components of the gear unit may largely change depending on the ambient temperature when the throttle valve abuts against the fully closing stopper. Thus, even if a duty ratio is smaller than a predetermined threshold value, the throttle valve may sometimes abut against the fully closing stopper.

As a recent trend for improving fuel economy or efficiency or others, the idling speed is set to a lower level. Further, there is an increasing demand for controlling the opening angle of the throttle valve until the throttle valve abuts against the fully closing stopper. Such circumstances increase the need for detecting the abutting position of the throttle valve against the fully closing stopper more accurately. This is because if abutting against the fully closing stopper is not detected accurately, the motor is driven continuously in order to close the throttle valve even though the throttle valve actually abuts against the fully closing stopper, resulting in an overloaded motor. Accordingly, the motor performance may drop or the motor may be broken down.

In a conventional electronic throttle control apparatus, moreover, an idling speed may not be lowered to a target speed or may be increased too high, so that a desired idling speed may not be maintained. The reason is as follows. Due to problems in an assembling precision of the throttle control apparatus or temperature characteristics of the throttle sensor, a control reference opening angle (a learned fully closed angle) and an actual (mechanical) fully closed angle may not coincide perfectly (that is, an error may occur).

Specifically, if the control reference opening angle becomes larger than the actual fully closed angle, when a target opening angle smaller than the control opening lower limit is calculated, the idling speed may not be lowered to the target rotating speed. If the control reference opening angle is smaller than the actual fully closed angle, when a target opening angle smaller than the actual fully opening angle is calculated, the throttle valve abuts against the fully closing stopper. When this abutting is detected, the control reference opening angle is changed to the actual throttle valve opening angle during the abutting determination. However, the control reference opening angle is correspondingly increased. Accordingly, the target opening angle calculated based on the control reference opening angle also becomes large, thereby increasing the idling speed.

SUMMARY OF THE INVENTION

The present invention has been made to control an opening angle of a throttle valve with a high precision and has an object to determine abutting of the throttle valve against a fully closing stopper precisely and to maintain a desired idling speed with a high precision.

To achieve the above object, the present invention provides an electronic throttle control apparatus including: a motor; a throttle valve which is driven by the motor to open and close; a throttle sensor for detecting an actual opening angle of the throttle valve; wherein the electronic throttle control apparatus is arranged to control an opening angle of the throttle valve by driving the motor so that the actual opening angle detected by the throttle sensor becomes a target opening angle, the electronic throttle control apparatus further includes a fully closing stopper of the throttle valve, and an abutting determination unit for determining whether the throttle valve abuts against the fully closing stopper, and the abutting determination unit is arranged to determine whether the throttle valve abuts against the fully closing stopper based on a determination condition preset with respect to each one of a plurality of duty ratio ranges.

According to another aspect, the present invention provides an electronic throttle control apparatus including: a motor; a throttle valve which is driven by the motor to open and close; a throttle sensor for detecting an actual opening angle of the throttle valve; wherein the electronic throttle control apparatus is arranged to drive the motor to control so that an opening angle of the throttle valve detected by the throttle sensor based on a learned control reference opening angle becomes a target opening angle, the apparatus further includes: a fully closing stopper, an abutting determination unit for determining whether the throttle valve abuts against the fully closing stopper, and a lower limit updating unit for updating a control opening lower limit of the throttle valve based on a determination result of the abutting determination unit, and the lower limit updating unit updates the control opening lower limit to the target opening angle when the abutting determination unit determines that the throttle valve does not abut against the fully closing stopper, while the lower limit updating unit updates the control opening lower limit to an opening angle detected by the throttle sensor when the abutting determination unit determines that the throttle valve abuts against the fully closing stopper.

DETAILED DESCRIPTION OF THE PREFERRED EMBODIMENTS

Figure 1:
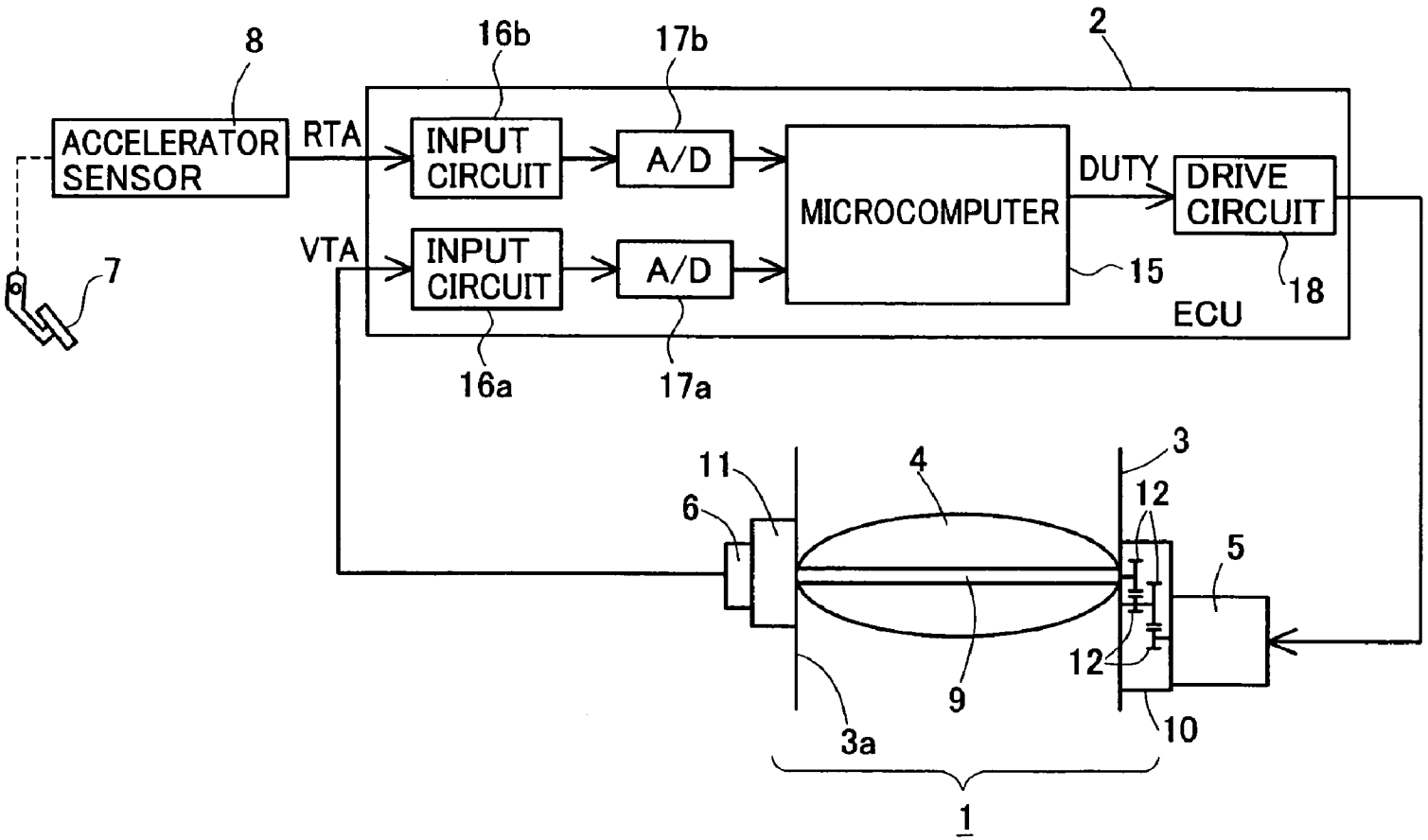
FIG. 1 is a schematic configuration view of an electronic throttle control apparatus.
Figure 2:
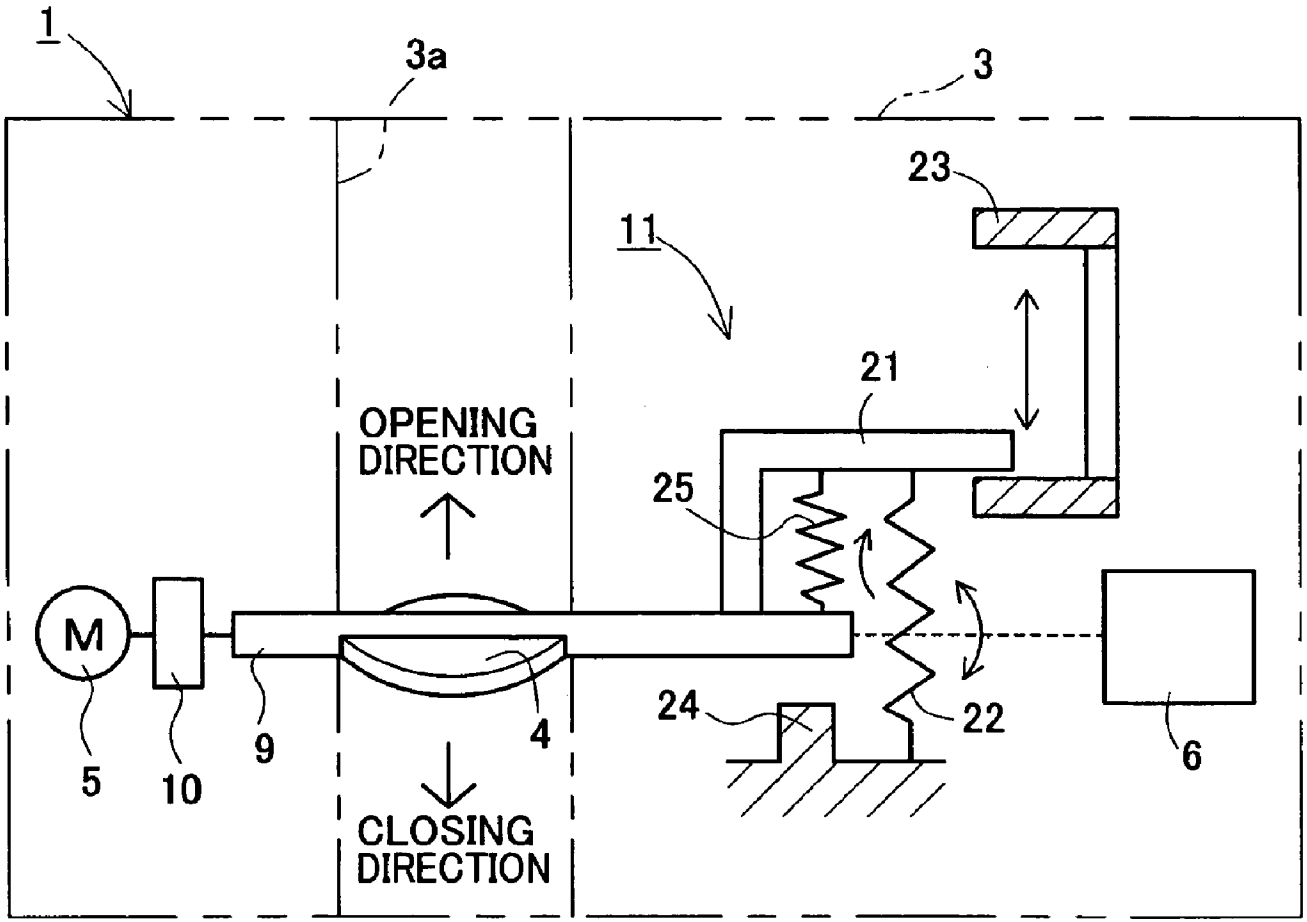
FIG. 2 is a schematic configuration view of an electronic throttle.
Figure 3:
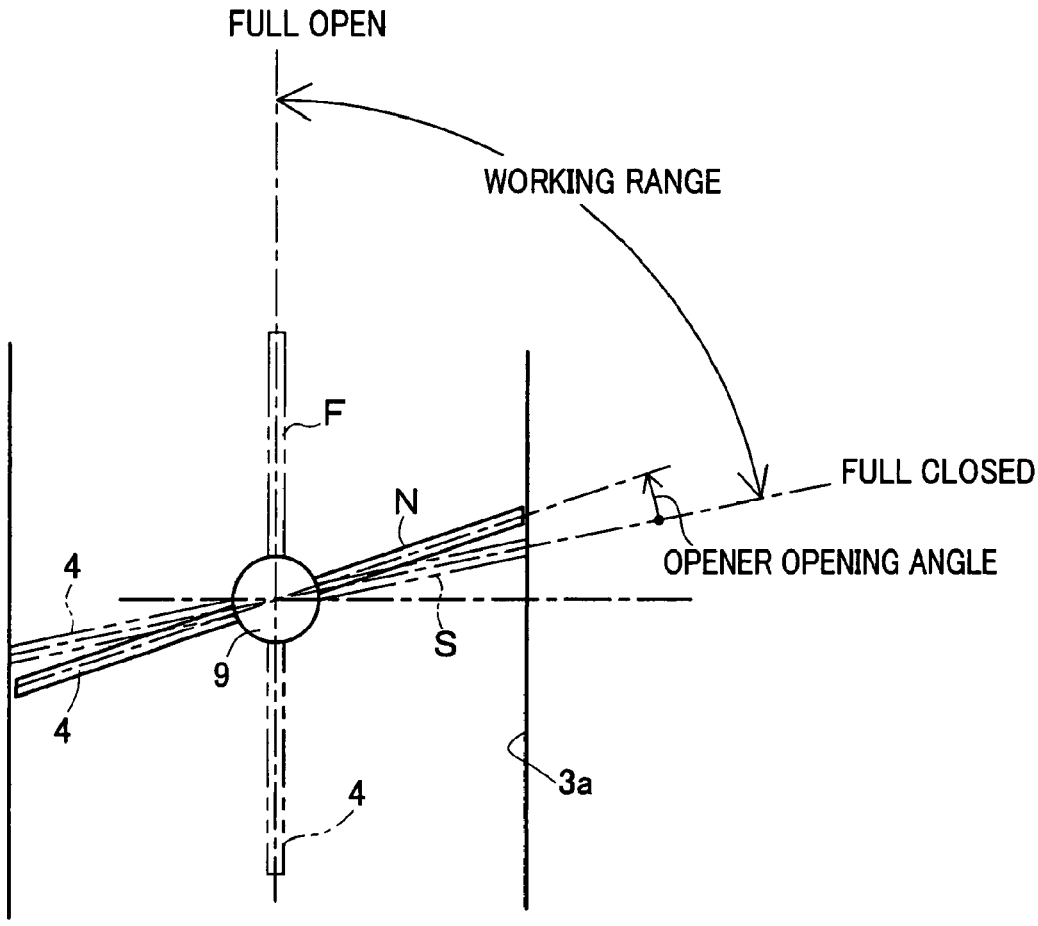
FIG. 3 is an explanatory view showing behaviors of a throttle valve.

A detailed description of a preferred embodiment of an electronic throttle control apparatus embodying the present invention will now be given referring to the accompanying drawings. The electronic throttle control apparatus of the present embodiment will be explained below referring to FIGS. 1 to 3. FIG. 1 is a schematic configuration view of the electronic throttle control apparatus of the present embodiment; FIG. 2 is a schematic configuration view of an electronic throttle; and FIG. 3 is an explanatory view showing behaviors of a throttle valve.

As shown in FIG. 1, an electronic throttle control apparatus includes an electronic throttle 1 and an electronic control unit (ECU) 2 for controlling the electronic throttle 1. The electronic throttle 1 is used for adjusting output of an automotive engine (not shown). The electronic throttle 1 is designed to open or close a throttle valve 4 placed in an engine intake passage (a throttle body) 3 by means of a motor 5 serving as an actuator, and to detect an actual opening angle (VTA) of the valve 4 by means of a throttle sensor 6.

The throttle valve 4 is a link-free type not mechanically cooperating with an operation of an accelerator pedal 7. That is, the throttle valve 4 is adapted to operate by receiving a driving force of the motor 5 driven by the ECU 2 depending on an operation extent of the accelerator pedal 7 detected by an accelerator sensor 8.

The throttle valve 4 is rotatably supported on the throttle body 3 by a throttle shaft 9 placed extending across a bore 3*a*. The motor 5 is coupled to one end of the throttle shaft 9 by way of a reduction device 10, and the throttle sensor 6 is coupled to the other end by way of an opener mechanism 11. An output shaft of the motor 5 is coupled to the throttle shaft 9 by way of plural gears 12 and others which constitute the reduction device 10. In the embodiment, for reduction in weight or the like, the gears 12 are made of resin.

The throttle sensor 6 is designed to detect and output the actual opening angle VTA of the electronic throttle 1 (the throttle valve 4). The sensor 6 is constituted of, for example, a potentiometer or a hall element. The accelerator sensor 8 is designed to detect and output the operation extent of the accelerator pedal 7 by operated a driver, as a target opening angle RTA, for setting the target opening angle RTA of the throttle valve 4. This sensor 8 is constituted of, for example, a potentiometer.

The opener mechanism 11 provided at one end of the throttle shaft 9 is arranged to hold the throttle valve 4 at an opener opening angle slightly opened from the fully closed state when power supply to the motor 5 is stopped.

As shown in FIG. 2, the electronic throttle 1 and the opener mechanism 11 are provided integrally in the throttle body 3. The throttle valve 4 is disposed in the bore 3*a* and is supported on the throttle body 3 in such a manner as to rotatable about the throttle shaft 9. The motor 5 is coupled to one end (a first end) of the throttle shaft 9 by way of the reduction device 10, and the throttle sensor 6 is coupled to the other end (a second end) of the shaft 9 together with the opener mechanism 11. In the present embodiment, for opening and closing of the throttle valve 4, as shown in FIG. 3, the direction from the fully closed position S to the fully open position F is referred to as an opening direction and the direction from the fully open position F to the fully closed position S is referred to a closing direction.

As shown in FIG. 2, the opener mechanism 11 provided at the second end of the throttle shaft 9 is provided with an opener lever 21 for holding the throttle valve 4 at a predetermined opener opening position N (see FIG. 3) while power is not supplied to the motor 5 for engine stop. To the opener lever 21, one end of a return spring 22 is connected. The other end of the return spring 22 is fixed to the throttle body 3. The return spring 22 is designed to urge the throttle valve 4 in the closing direction by way of the opener lever 21. The opener lever 21 is engaged with a fully opening stopper 23 at a predetermined rotating position, and is stopped.

The throttle body 3 has a fully closing stopper 24 for holding the throttle valve 4 in the fully closed position S (see FIG. 3). To the opener lever 21, one end of an opener spring 25 is connected. The other end of the opener spring 25 is connected to the throttle shaft 9. The opener spring 25 is designed to urge the throttle valve 4 in the opening direction. The opener lever 21, the return spring 22, the fully opening stopper 23, the fully closing stopper 24, and the opener spring 25 are combined to constitute the opener mechanism 11.

To open the throttle valve 4 from the opener opening position N to the fully open position F, the driving force of the motor 5 is applied to the throttle shaft 9 against the urging force of the return spring 21, allowing the throttle shaft 9 to rotate until the opener lever 21 is engaged with the fully opening stopper 23. On the other hand, to close the throttle valve 4 from the opener opening position N to the fully closed position S, the driving force of the motor 5 is applied to the throttle shaft 9 against the urging force of the return spring 25, allowing the throttle shaft 9 to rotate until it is engaged with the fully closing stopper 24.

During an engine operation, the motor 5 is controlled by the ECU 2 based on the operation of the accelerator pedal 7, so that the throttle valve 4 is opened to a predetermined target opening angle. At this time, the opening angle of the throttle valve 4 is determined somewhere in a working range from the fully closed position S to the fully open position F as shown in FIG. 3, based on the operation of the acceleration pedal 7. At the fully open position F, the opener lever 21 is engaged with the fully opening stopper 23 and therefore the throttle valve 4 is held to open the bore 3*a* at the maximum extent. At fully closed position S, the throttle shaft 9 is engaged with the fully closing stopper 24 and the throttle valve 4 is held to close the bore 3*a* at the maximum extent. This position of the throttle valve 4 is detected by abutting determination described below.

The ECU 2 for comprehensively controlling the electronic throttle 1 by judging the abutting position, updating the lower limit guard value of the control opening lower limit, and others includes a microcomputer 15, input circuits 16*a*, 16*b*, A/D converters 17*a*, 17*b*, and a drive circuit 18, as shown in FIG. 1. The microcomputer 15 is arranged to control the electronic throttle 1, and corresponds to an abutting determination unit of the invention. The microcomputer 15 generally includes a central processing unit (CPU), a random access memory (RAM), a read-only memory (ROM), and others. The ROM stores various control programs about the electronic throttle 1, such as an abutting determination program, and a lower limit guard value updating program.

The input circuits 16*a*, 16*b* serve to remove noise from input signals. The A/D converters 17*a*, 17*b* serve to convert analog signals into digital signals. The drive circuit 18 serves to supply a driving current to the motor 5 depending on an output signal from the microcomputer 15.

As shown in FIG. 1, the analog signal representing the actual opening angle VTA output from the throttle sensor 6 is supplied to the input circuit 16*a*, and given to the A/D converter 17*a* to be converted into a digital signal, which is input into the microcomputer 15. The analog signal representing the target opening angle RTA output from the accelerator sensor 8 is also supplied to the input circuit 16*b*, and given to the A/D converter 17*b* to be converted into a digital signal, which is input into the microcomputer 15.

The microcomputer 15 controls the motor 5 by processing the input signals relevant to the actual opening angle VTA and target opening angle RTA according to a PID control technique. That is, the microcomputer 15 calculates an opening angle deviation ER of the actual opening angle VTA to the target opening angle RTA from the input signal, and calculates a PID control amount VPID according to a predetermined computational expression, based on this opening angle deviation ER. The microcomputer 15 outputs a duty ratio DUTY as a driving current depending on the control amount VPID to the motor 5 by way of the drive circuit 18. As a result, a driving amount of the motor 5 is controlled, and the actual opening angle VTA of the throttle valve 4 is controlled to coincide with the target opening angle RTA.

Figure 4:
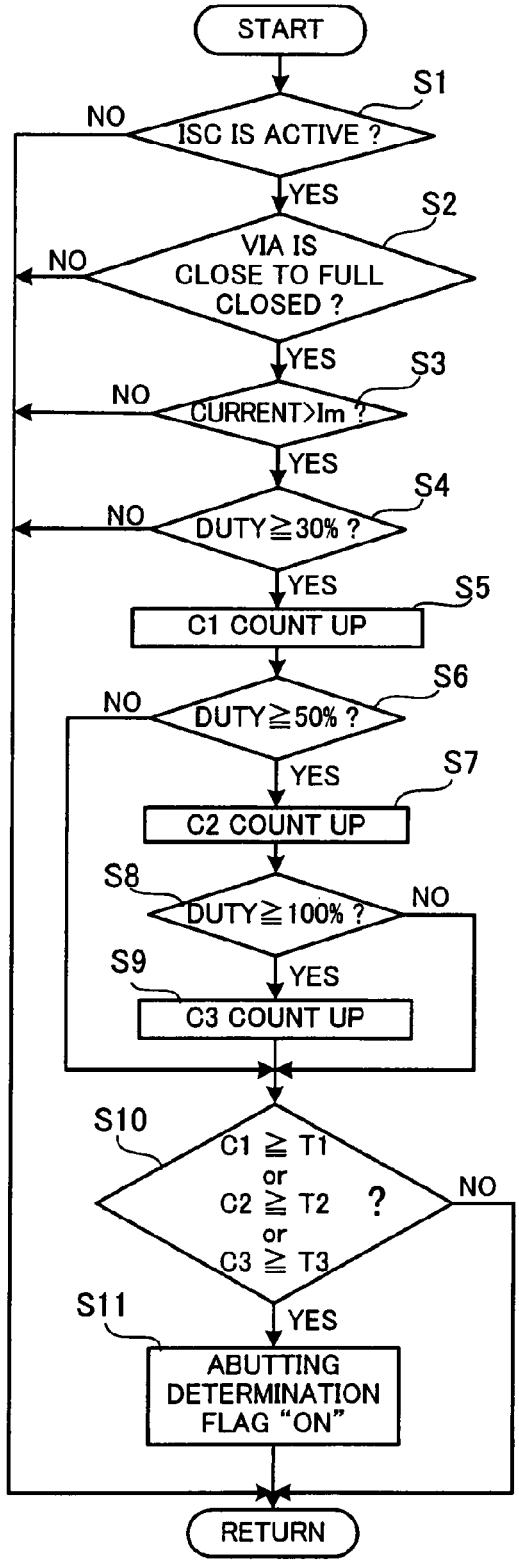
FIG. 4 is a flowchart showing processes of an abutting determination processing.

In the electronic throttle control apparatus of the embodiment, the abutting determination processing for detecting that the throttle shaft 9 is engaged with the fully closing stopper 24 is explained referring to FIG. 4. FIG. 4 is a flowchart of the abutting determination processing.

The abutting determination processing is executed when, for example, it is necessary to lower the rotating speed while the engine is idling (due to increase of air intake volume by expansion of the bore 3*a* or the like). In this case, when the throttle valve 4 is closed for lowering the rotating speed, the throttle shaft 9 may hit against the fully closing stopper 24 due to an individual difference (such as an assembling error) of the electronic throttle 1.

Accordingly, the abutting determination processing begins with determination by the microcomputer 15 as to whether the idling speed control (ISC) is active or not (S1). Specifically, it is determined whether the ISC is active or not based on the actual opening angle VTA detected by the throttle sensor 6. In the embodiment, it is determined whether the actual opening angle VTA is 2 degrees or less.

When the ISC is active (S1: Yes), the microcomputer 15 then determines whether the actual opening angle VTA detected by the throttle sensor 6 is close to the fully closed angle (opening angle: 0 degree) (S2). Specifically it is determined whether the actual opening angle VTA is 1 degree or less.

If the ISC is not active (S1: No) or if the ISC is active but the actual opening angle VTA is larger than 1 degree (S2: No), this processing routine is terminated.

In S2, if the microcomputer 15 determines that the actual opening angle VTA is 1 degree or less (S2: Yes), it is determined whether the current flowing in the motor 5 is larger than a predetermined value Im (set at 2 A in the embodiment) or not (S3). The predetermined value Im is determined in consideration of a safety factor for a minimum value of current possibly leading to breakdown of the motor of the electronic throttle.

In S3, when the microcomputer 15 determines that the current flowing in the motor 5 is 2 A or less (S3: No), this processing routine is terminated. When the microcomputer 15 determines that the current flowing in the motor 5 is more than 2 A (S3: Yes), it is then determined whether the duty ratio DUTY is 30% or more (S4).

In S4, when the microcomputer 15 determines that the duty ratio DUTY is less than 30% (S4: No), this processing routine is terminated. When the microcomputer 15 determines that the duty ratio DUTY is 30% or more (S4: Yes), a weak-abutting counter C1 starts counting up (S5). The weak-abutting counter C1 continues to count until the duty ratio DUTY becomes less than 30%. The weak-abutting counter C1 is reset when the duty ratio DUTY becomes less than 30% and then the counter C1 starts counting up again when the duty ratio DUTY later becomes 30% or more.

Further, the microcomputer 15 determines whether the duty ratio DUTY is 50% or more (S6). In S6, when the microcomputer 15 determines that the duty ratio DUTY is less than 50% (S6: No), the process advances to S10. On the other hand, when the microcomputer 15 determines that the duty ratio DUTY is 50% or more (S6: Yes), a medium-abutting counter C2 starts counting up (S7). The medium-abutting counter C2 continues to count until the duty ratio DUTY becomes less than 50%. The medium-abutting counter C2 is reset when the duty ratio DUTY becomes less than 50% and then the counter C2 starts counting up again when the duty ratio DUTY later becomes 50% or more.

The microcomputer 15 determines whether the duty ratio DUTY is 100% or more (S8). In S8, when the microcomputer 15 determines that the duty ratio DUTY is less than 100% (S8: No), the process advances to S10. On the other hand, when the microcomputer 15 determines that the duty ratio DUTY is 100% or more (S8: Yes), a strong-abutting counter C3 starts counting up (S8). The strong-abutting counter C3 continues to count until the duty ratio DUTY becomes less than 100%. The strong-abutting counter C3 is reset when the duty ratio DUTY becomes less than 100% and then the counter C3 starts counting up again when the duty ratio DUTY later becomes 100% or more.

In S10, the microcomputer 15 makes a abutting determination by checking whether the throttle shaft 9 is engaged with a fully closing stopper 24 or not. Specifically, when at least one of the following conditions (1) to (3) is established, it is determined that the throttle shaft 9 is engaged with (or abuts against) the fully closing stopper 24. The determination conditions are: (1) the counting value of the counter C1 is equal to or more than a predetermined time T1 (3000 ms in the embodiment), (2) the counting value of the counter C2 is equal to or more than a predetermined time T2 (400 ms in the embodiment), and (3) the counting value of the counter C3 is equal to or more than a predetermined time T3 (300 ms in the embodiment). When any one of the conditions (1) to (3) is established (S10: Yes), an abutting determination flag is turned on (S11), and, for example, the lower limit guard value is updated, and the opening angle of the throttle valve 4 is controlled so that the throttle shaft 9 may not be engaged with the fully closing stopper 24. The determination time values T1 to T3 may be set so that the motor of the electronic throttle may not be broken down and that the abutting may not be determined falsely.

In the embodiment, the microcomputer 15 judges abutting to the fully closing stopper 24 based on determination conditions individually preset with respect to plural duty ratio ranges (i.e., three duty ratio ranges in the present embodiment). As a result, even at the low duty ratio conventionally not judged for abutting (a duty ratio of 30% or more in the embodiment), abutting against the fully closing stopper 24 can be detected precisely. Hence, the motor 5 is not driven continuously for closing the throttle valve 4 while the throttle shaft 9 is engaged with (or abuts against) the fully closing stopper 24. Therefore, the motor 5 is not overloaded, and a performance deterioration or breakdown of the motor 5 can be prevented securely. In addition, abutting can be judged precisely even at a low duty ratio, an excessive current is not supplied to the motor 5, and a power consumption can be saved.

Figure 5:
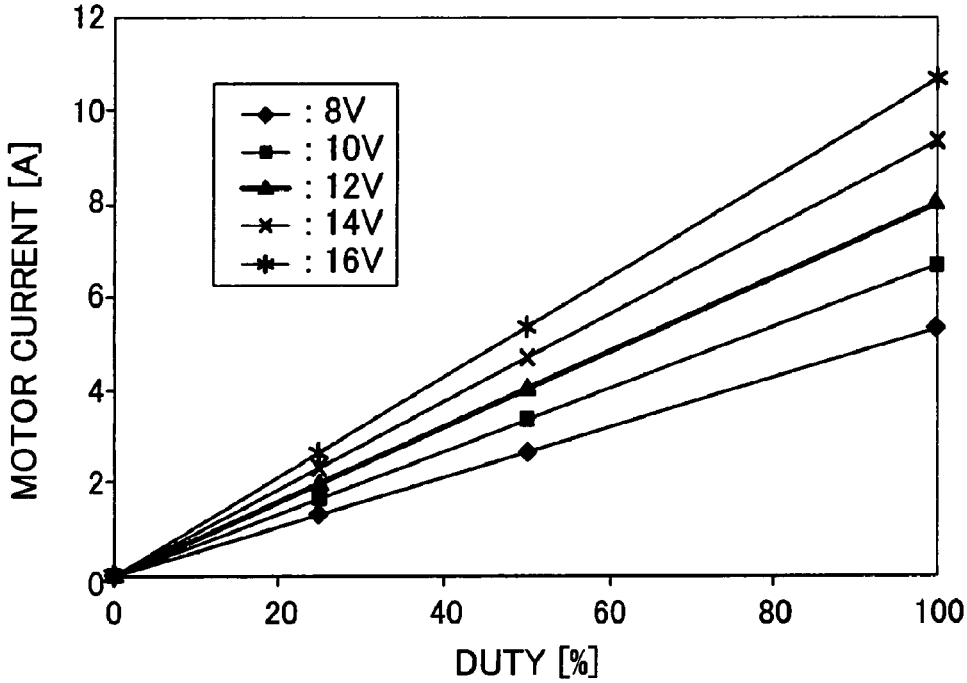
FIG. 5 is a graph showing changes in relation between motor current and determination duty ratio in relation to battery voltage.

Another abutting determination processing is explained. In this processing, the duty ratio in an abutting determination condition (a determination duty ratio) is changed (corrected) depending on the battery voltage. Accordingly, the microcomputer 15 stores a data map of data on a relationship between battery voltage and determination duty ratio as shown in FIG. 5. FIG. 5 is a graph showing changes in relationship between motor current and determination duty ratio in relation to battery voltage.

Figure 6:
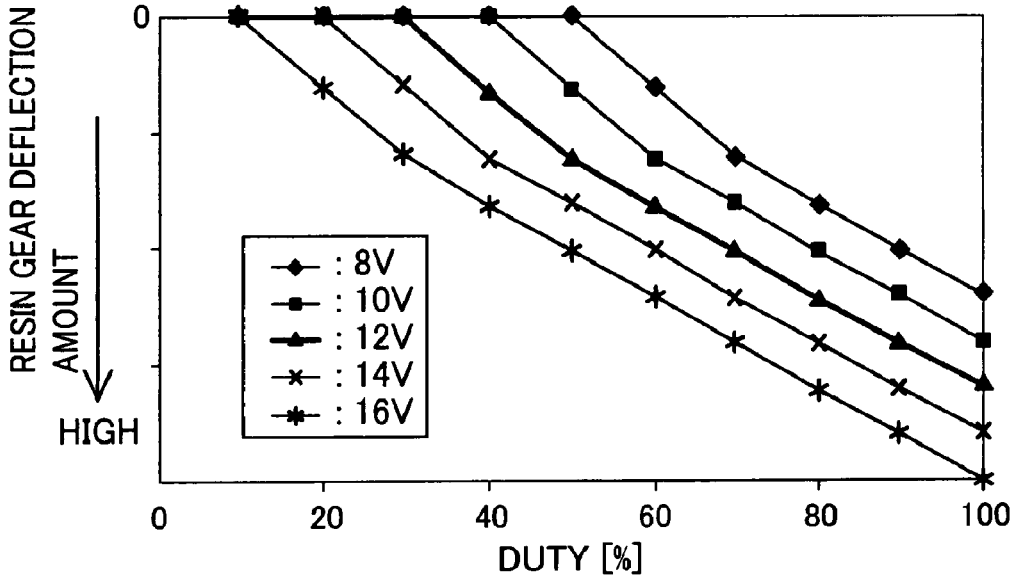
FIG. 6 is a graph showing changes in flexibility of a gear with respect to battery voltage.

The reason why the duty ratio in the abutting determination condition is changed depending on the battery voltage is that the abutting against the fully closing stopper can be judged more precisely. That is, as shown in FIG. 6, if the duty ratio is the same, at different battery voltages, flexibility of the resin gear 12 varies. Specifically, at a higher battery voltage, the flexibility increases, while at a lower battery voltage, the flexibility decreases. Thus, in spite of battery voltage changes, if the duty ratio is fixed in the abutting determination condition, the flexibility problem occurs and the abutting cannot be judged precisely. FIG. 6 is a graph showing changes in the gear flexibility with respect to the battery voltage.

Figure 7:
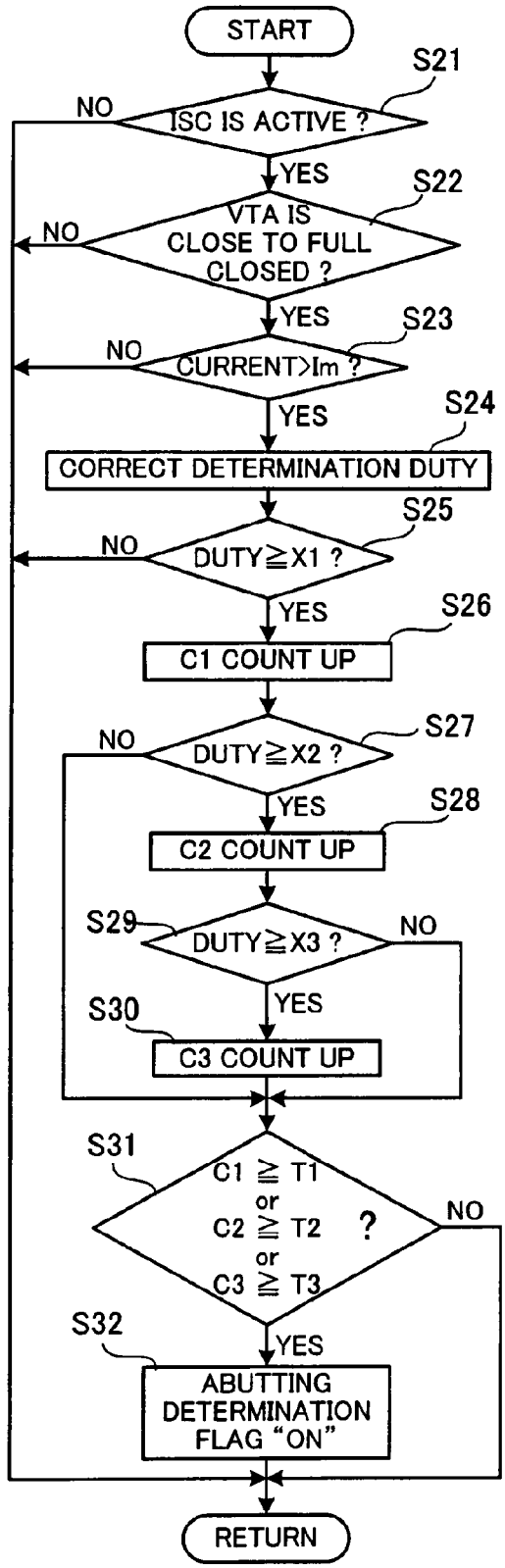
FIG. 7 is a flowchart showing processes of the abutting determination processing.

Another abutting determination processing is explained below referring to FIG. 7. FIG. 7 is a flowchart showing processes of the abutting determination processing.

In the abutting determination processing in this embodiment, the microcomputer 15 also begins with determination as to whether the idling speed control (ISC) is active or not (S21).

If the ISC is active (S21: Yes), the microcomputer 15 determines whether the actual opening angle VTA detected by the throttle sensor 6 is close to the fully closed angle (VTA is 1 degree or less) or not (S22).

If the ISC is not active (S21: No) or if the ISC is active but the actual opening angle VTA is larger than 1 degree (S22: No), this processing routine is terminated.

In S22, if the microcomputer 15 determines that the actual opening angle VTA is 1 degree or less (S22: Yes), it is checked if the current flowing in the motor 5 is larger than a predetermined value Im (set at 2 A in the embodiment) or not (S23).

In S23, when the microcomputer 15 determines that the current flowing in the motor 5 is 2 A or less (S23: No), this processing routine is terminated. When the microcomputer 15 determines that the current flowing in the motor 5 is more than 2 A (S23: Yes), the determination duty ratios X1, X2, X3 are corrected (S24). In other words, the determination duty ratios X1, X2, X3 in each process of S25, S27, S29 are changed (determined). Initial values of the determination duty ratios X1, X2, X3 are set at duty ratios 30%, 50%, and 100% at the reference voltage (12 V) (same as in the above embodiment).

In S24, for example, if a battery voltage of 16 V is detected, the determination duty ratios X1, X2, X3 are corrected (set) as X1=22%, X2=38%, X3=75% based on the data map (see FIG. 5). When a battery voltage of 8 V is detected, the determination duty ratios X1, X2, X3 are corrected (set) as X1=46%, X2=76%, X3=100% based on the data map (see FIG. 5). That is, the determination duty ratios X1, X2, X3 are corrected (set) according to the data map (see FIG. 5) so that the same torque motor as the initial value obtained at the reference voltage (12V) may be generated (the motor current may be the same).

When the determination duty ratios X1, X2, X3 are corrected (set) depending on the battery voltage, the microcomputer 15 determines whether the duty ratio DUTY is X1 or more (S25).

In S25, when the microcomputer 15 determines that the duty ratio DUTY is less than X1 (S25: No), this processing routine is terminated. When the microcomputer 15 determines that the duty ratio DUTY is X1 or more (S25: Yes), the weak-abutting counter C1 starts counting (S26). The weak-abutting counter C1 continues to count up until the duty ratio DUTY becomes less than X1. The weak-abutting counter C1 is reset when the duty ratio DUTY becomes less than X1, and when the duty ratio DUTY later becomes X1 or more, counting up is started again.

The microcomputer 15 determines whether the duty ratio DUTY is X2 or more (S27). In S27, when the microcomputer 15 determines that the duty ratio DUTY is less than X2 (S27: No), the process advances to S31. On the other hand, when the microcomputer 15 determines that the duty ratio DUTY is X2 or more (S27: Yes), the medium-abutting counter C2 starts counting up (S28). The medium-abutting counter C2 continues to count until the duty ratio DUTY becomes less than X2. The medium-abutting counter C2 is reset when the duty ratio DUTY becomes less than X2, and when the duty ratio DUTY later becomes X2 or more, counting up is started again.

The microcomputer 15 determines whether the duty ratio DUTY is X3 or more (S29). In S29, when the microcomputer 15 determines that the duty ratio DUTY is less than X3 (S29: No), the process advances to S31. On the other hand, when the microcomputer 15 determines that the duty ratio DUTY is X3 or more (S29: Yes), a strong-abutting counter C3 starts counting up (S30). The strong abutting counter C3 continues to count until the duty ratio DUTY becomes less than X3. The strong-abutting counter C3 is reset when the duty ratio DUTY becomes less than X3, and when the duty ratio DUTY later becomes X3 or more, counting up is started again.

In S31, the microcomputer 15 determines abutting of the throttle shaft 9 against the fully closing stopper 24 by checking if the throttle shaft 9 is engaged with the fully closing stopper 24. Specifically, when at least one of the following conditions (1) to (3) is established, it is determined that the throttle shaft 9 is engaged with (or abuts against) the fully closing stopper 24. The determination conditions are (1) the counting value of the counter C1 is equal to or more than a predetermined time T1 (3000 ms in the embodiment), (2) the counting value of the counter C2 is equal to or more than a predetermined time T2 (400 ms in the embodiment), and (3) the counting value of the counter C3 is equal to or more than a predetermined time T3 (300 ms in the embodiment). When any one of the conditions (1) to (3) is established (S31: Yes), the abutting determination flag is turned on (S32), and, for example, the lower limit guard value is updated, and the opening angle of the throttle valve 4 is controlled so that the throttle shaft 9 may not be engaged with the fully closing stopper 24.

As above, in a different abutting determination processing, the microcomputer 15 determines abutting of the throttle shaft 9 against the fully closing stopper 24 based on the three determination conditions individually preset (corrected) with respect to the duty ratio ranges depending on the battery voltage. As a result, even at the low duty ratio conventionally not judged for abutting (a duty ratio of 30% or more in the embodiment), abutting against the fully closing stopper 24 can be detected more precisely. Hence, the motor 5 is not driven continuously for closing the throttle valve 4 while the throttle shaft 9 is engaged with (or abuts against) the fully closing stopper 24. Therefore, the motor 5 is not overloaded, and performance deterioration or breakdown of the motor 5 can be prevented securely. In addition, abutting can be judged precisely even at the low duty ratio, so that an excessive current is not supplied to the motor 5, and hence power consumption can be saved.

Figure 8:
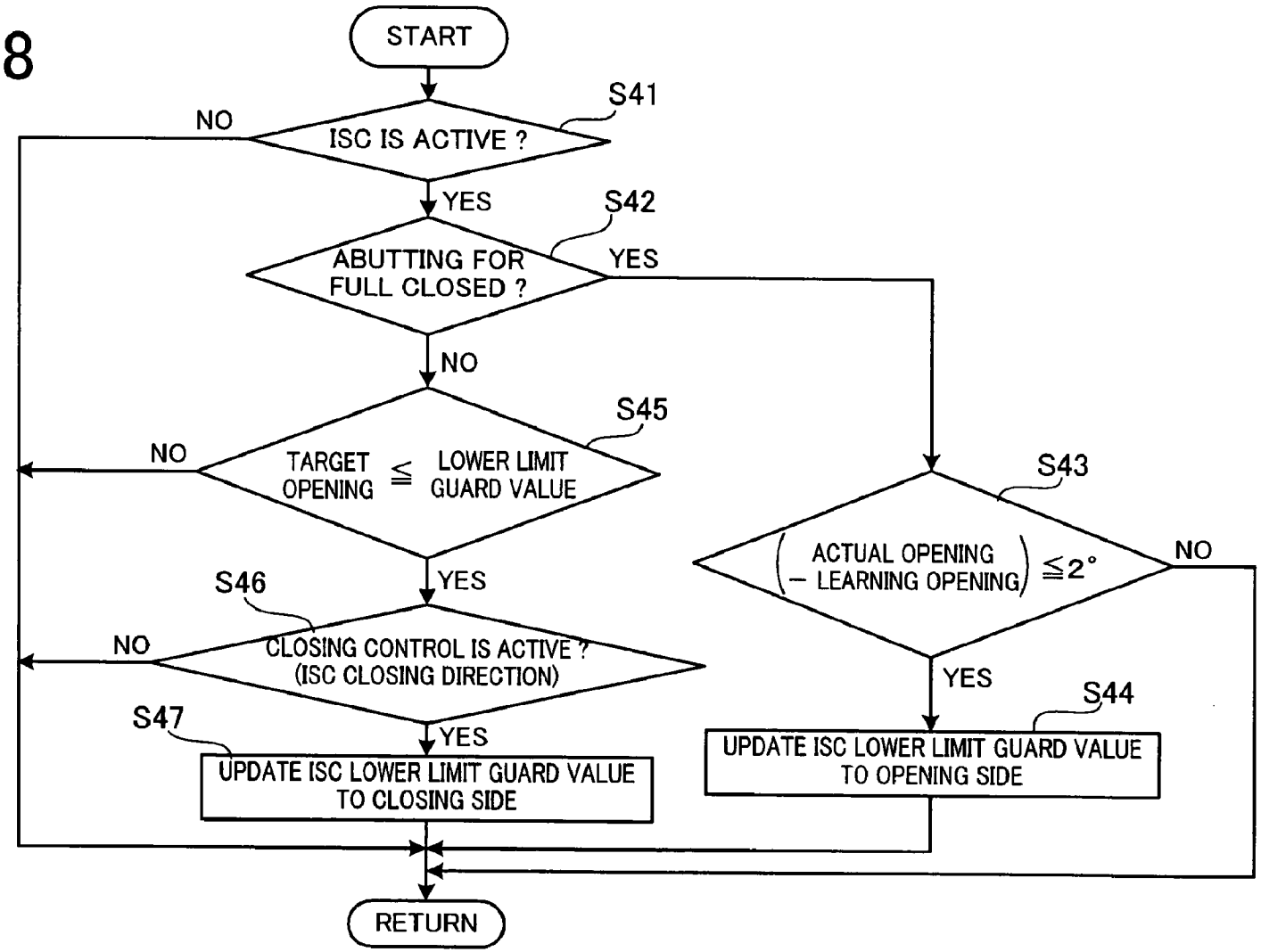
FIG. 8 is a flowchart showing processes of an updating processing for an ISC lower limit guard value.

In the electronic throttle control apparatus of the embodiment, an updating processing of the ISC lower limit guard value for maintaining desired idling speed is explained by referring to FIG. 8. FIG. 8 is a flowchart showing processes of the updating processing for the ISC lower limit guard value.

In the updating processing of the ISC lower limit guard value, first, the microcomputer 15 determines whether the ISC is active or not (S41). Specifically, it is determined whether the ISC is active or not based on the actual opening angle VTA detected by the throttle sensor 6. In the embodiment, it is determined whether or not the actual opening angle VTA is 3 degrees or less.

If the ISC is active (S41: Yes), the microcomputer 15 then determines abutting by checking if the throttle shaft 9 is engaged with the fully closing stopper 24 (S42). This abutting determination may be executed according to a known method or the aforementioned abutting determination processing.

In S42, if the microcomputer 15 detects abutting, that is, determined that the throttle shaft 9 is engaged with the fully closing stopper 24 (S42: Yes), it further determines whether the opening angle difference between the actual opening angle VTA (the actual fully closed opening angle) and the ISC learning opening angle (the control reference opening angle) is the predetermined value or less (S43). This microcomputer 15 corresponds to the opening angle difference determination unit of the invention. In the embodiment, the predetermined value is set at 2 degrees.

In S43, when the microcomputer 15 determines that the difference between the actual opening angle VTA during abutting and the ISC learning opening angle is the predetermined value or less (S43: Yes), the ISC lower limit guard value is updated to the actual fully closed angle (the actual opening angle VTA during abutting) (S44). This microcomputer 15 corresponds to the lower limit updating unit of the invention. After this process at S43, the ISC lower limit guard value is updated in the opening direction. At this time, the ISC learning opening angle is not updated.

On the other hand, when the microcomputer 15 determines that the difference between the actual opening angle VTA during abutting and the ISC learning opening angle is not the predetermined value or less (S43: No), the ISC lower limit guard value is not updated, and this processing routine is terminated.

Accordingly, if the ISC learning opening angle is determined to be less than the actual fully closed angle (the actual opening angle VTA during abutting) due to an assembling error or a temperature characteristic of the throttle sensor 6 and it is determined that the throttle shaft 9 is engaged with the fully closing stopper 24, the ISC lower limit guard value is updated to the actual fully closed angle as far as the difference between the actual opening angle VTA during abutting and the ISC learning opening angle is the predetermined value or less. At this time, the throttle shaft 9 is engaged with the fully closing stopper 24. However, unlike the conventional electronic throttle apparatus, the ISC learning opening angle is not changed (updated). Thus, the target opening angle RTA calculated based on the ISC learning opening angle is not changed, and therefore the opening angle of the throttle valve 4 is the ISC lower limit guard value, thus preventing idling speed from increasing.

Simultaneously, the ISC lower limit guard value is updated in the opening direction, but the ISC lower limit guard value to be updated has an upper limit because updating of the ISC lower limit guard value is inhibited if the opening angle difference is larger than the predetermined value. Therefore, the updated ISC lower limit guard value is prevented from being larger than the target opening angle RTA calculated based on the ISC learning opening angle. This makes it possible to reliably prevent the idling speed from increasing due to updating of the ISC lower limit guard value.

On the other hand, in S42, when the microcomputer 15 detects no abutting, that is, determines that the throttle shaft 9 is not engaged with the fully closing stopper 24 (S42: No), it successively make a comparison between the target opening angle RTA and the ISC lower limit guard value (S45). This microcomputer 15 corresponds to the opening angle comparing unit of the invention.

When the target opening angle RTA is the ISC lower limit guard value or less (S45: Yes), it is determined whether the throttle valve 4 is being controlled to rotate in the closing direction (S46). This determination may be executed based on for example an opening angle change rate of the throttle valve 4.

To the contrary, when the target opening angle RTA is more than the ISC lower limit guard value (S45: No), showing that the idling speed is lowered to the target rotating speed by the ISC lower limit guard value, the ISC lower limit guard value is not updated, and this processing routine is terminated. Thus, an unnecessary updating of the ISC lower limit guard value can be avoided.

In S46, when microcomputer 15 determines that the throttle valve 4 is being controlled to rotate in the closing direction (S46: Yes), the ISC lower limit guard value is updated to the target opening angle (S47). At this time, in the present embodiment, the ISC lower limit guard value is updated by being gradually changed to the target opening angle at a predetermined rate. Specifically, it is updated in every 0.03 degree.

Accordingly, if the ISC learning opening degree is greater than the actual fully closed angle due to an assembling error or a temperature characteristic of the throttle sensor 6, the ISC lower limit guard value is updated to the target opening angle RTA as far as the target opening angle RTA is smaller than the ISC lower limit guard value. As a result, the ISC lower limit guard value becomes equal to the target opening angle RTA. It is therefore possible to avoid the problem that the throttle valve 4 is unable to be closed (rotated) to the target opening angle RTA due to the ISC lower limit guard value. Hence, the idling speed can be decreased to target rotating speed.

In the embodiment, the ISC lower limit guard value is updated by being gradually changed at a predetermined rate, the throttle valve 4 is not closed suddenly. Accordingly, a damage of the throttle gear or the like can be prevented securely even if the throttle shaft 9 is engaged with (or abuts against) the fully closing stopper 24.

Meanwhile, if it is determined that the throttle valve 4 is controlled to rotate in the opening direction (S46: No), it is no longer necessary to update the ISC lower limit guard value in the closing direction. Thus, this processing routine is terminated.

Figure 9:
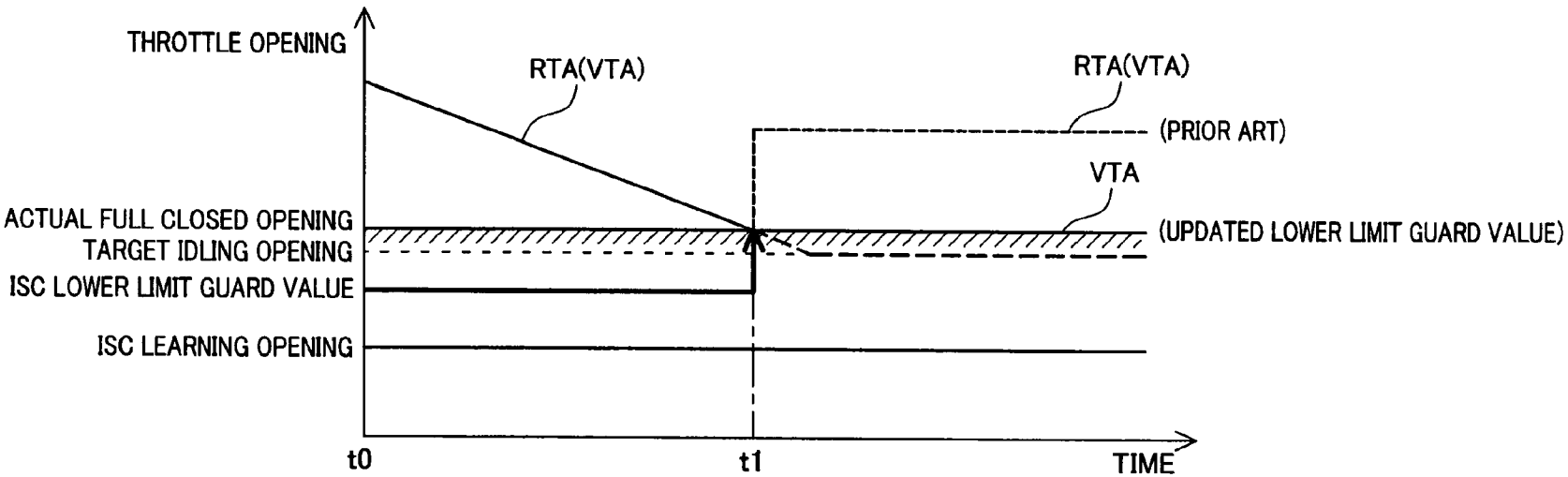
FIG. 9 is a timing chart showing changes of various control opening angles in the lower limit guard value updating processing in a case where an ISC learning opening angle is smaller than an actual fully closed angle.
Figure 10:
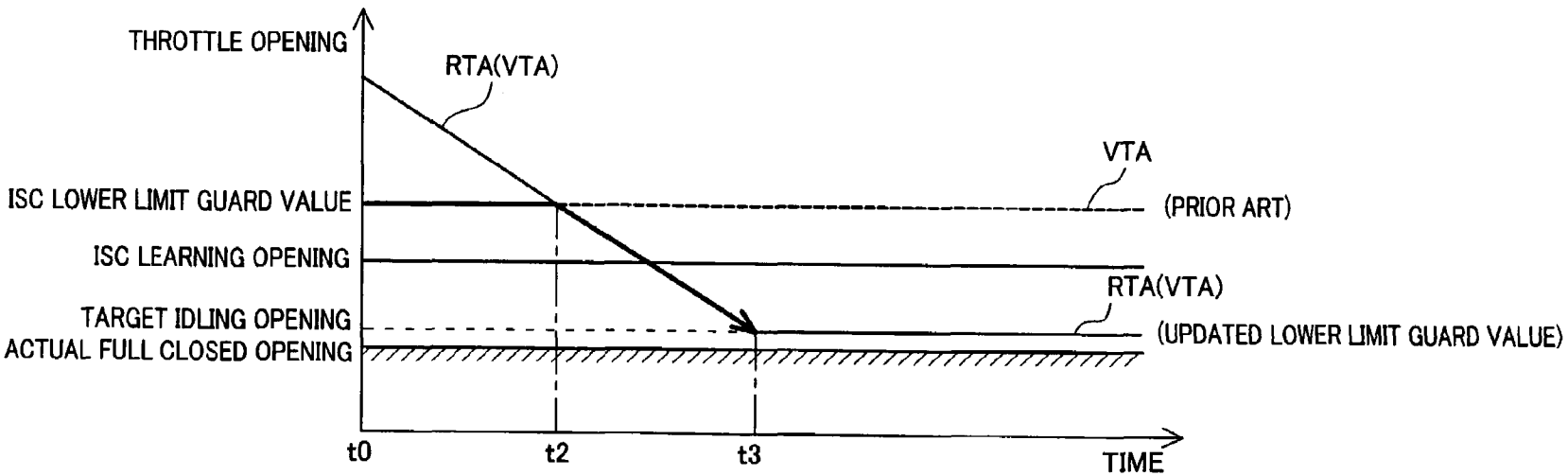
FIG. 10 is a timing chart showing changes of various control opening angles in the lower limit guard value updating processing in a case where an ISC learning opening angle is larger than an actual fully closed angle.

Changes of various control opening angles in this updating processing of the lower limit guard value are further explained below, referring to FIG. 9 and FIG. 10. FIG. 9 is a timing chart showing changes of various control opening angles in the updating processing of the lower limit guard value when the ISC learning opening angle is smaller than the actual fully closed angle. FIG. 10 is a timing chart showing changes of various control opening angles in the updating processing of the lower limit guard value when the ISC learning opening angle is larger than the actual fully closed angle.

First, the case where the ISC learning opening angle is smaller than the actual fully closed angle is explained referring to FIG. 9. When the engine is started at time t0, the ISC is put in action, gradually decreasing the target opening angle RTA to become equal to the target idle opening angle. To follow this trend, the actual opening angle VTA of the throttle valve 4 decreases. In other words, the control is executed to regulate the idling speed to the predetermined target rotating speed. At time t1 during ISC operation, the actual opening angle VTA becomes the actual fully closed angle. That is, the throttle shaft 9 is engaged with the fully closing stopper 24.

In the conventional electronic throttle control apparatus, at time t1, the ISC learning opening angle is changed (updated) to the actual fully closed angle. As a result, the target opening angle RTA is also changed. At this time, as shown in FIG. 9, the target opening angle RTA is changed in the opening direction, the actual opening angle RTA increases, causing the idling speed to rise.

On the other hand, in the embodiment, at time t1, the ISC learning opening angle is not changed, but the ISC lower limit guard value is updated to the actual fully closed angle. As a result, as clear from FIG. 9, the actual opening angle VTA is prevented from being increased as in the prior art, and is nearly same as (or slightly larger than) the target idling speed. This makes it possible to avoid the problem that the idling speed rises and hence maintaining the idling speed near the desired target rotating speed.

The case where the ISC learning opening angle is larger than the actual fully closed angle is explained below, referring to FIG. 10. When the engine is started at time t0, the ISC control is put in action, gradually decreasing the target opening angle RTA to become equal to the target idling speed. Following this operation, the actual opening angle VTA of the throttle valve 4 decreases. In other words, the control is executed to regulate the idling speed to the desired target rotating speed. At time t2 during ISC operation, the target opening angle RTA becomes the ISC lower limit guard value.

In the conventional electronic throttle control apparatus, after time t2, the opening angle of the throttle valve 4 could not be further decreased because of the lower limit guard value. As a result, the actual opening angle VTA of the throttle valve 4 becomes the ISC lower limit guard value larger than the target idling opening angle, so that the idling speed is not lowered to the desired target rotating speed.

In the present embodiment, on the other hand, after time t2, the ISC lower limit guard value is larger than the target opening angle RTA, and therefore the ISC lower limit guard value is gradually updated to be equal to the target opening angle RTA. Finally, at time t3, the ISC lower limit guard value is updated to the target idling opening angle. As a result, as clear from FIG. 10, the actual opening angle VTA does not exceed the target idling opening angle unlike the prior art, and becomes equal to the target idling opening angle. Therefore, the problem that the idling speed is not decreased can reliably be avoided, and the idling speed can be maintained at a desired target speed.

By this updating processing of the ISC lower limit guard value of the present embodiment, if the ISC learning opening angle becomes smaller than the actual fully closed angle (actual opening angle VTA when abutting) due to an assembling error or a temperature characteristic of the throttle sensor 6, when the microcomputer 15 determines that the throttle shaft 9 is engaged with the fully closing stopper 24, the ISC lower limit guard value is updated to the actual fully closed angle as far as the opening angle difference between the actual opening angle VTA during abutting and the ISC learning opening angle is a predetermined value or less. At this time, the ISC learning opening angle is not changed (not updated), the target opening angle RTA calculated based on the ISC learning opening angle is not changed. Accordingly, the opening angle of the throttle valve 4 becomes the ISC lower limit guard value. Thus, the idling speed can be prevented from rising.

Further, if the ISC learning opening angle is larger than the actual fully closed angle due to an assembling error or a temperature characteristic of the throttle sensor 6, the ISC lower limit is updated to the target opening angle RTA as far as the microcomputer 15 determines that the target opening angle RTA is smaller than the ISC lower limit guard value. Therefore, the ISC lower limit guard value becomes equal to the target opening angle RTA, and a failure in closing the throttle valve 4 up to the target opening angle RTA due to the ISC lower limit guard value can be avoided. Hence, the idling speed can be lowered to the target rotating speed. At this time, the ISC lower limit guard value is updated by being gradually changed at a predetermined rate, the throttle valve 4 is not closed suddenly. Accordingly, even if the throttle shaft 9 is engaged with (or abuts against) the fully closing stopper 24, a damage of the throttle gear and others can be prevented securely.

The foregoing embodiments are merely examples, and are not intended to limit the scope of the invention, which may be changed and modified in various forms without departing from the true spirit thereof. For example, in the embodiments, the duty ratio for determining abutting is predetermined in three regions, but not limited to three, the determination duty ratio may be specified in two, or four or more regions.

In the aforementioned embodiments, resin-made throttle gears are used. There may be a case where, due to the throttle gears deflected at the time of the abutting determination, so that the actual opening angle has become smaller than the actual fully closed opening angle. Therefore, when resin throttle gears are used, the ISC lower limit guard value may be updated after taking the flexibility of the throttle gear into account (after correcting the flexibility of the throttle gear).

Specific numerical values cited in the embodiments are merely examples and are not limitative.

What is claimed is:

1. An electronic throttle control apparatus including:

a motor;

a throttle valve which is driven by the motor to open and close;

a throttle sensor for detecting an actual opening angle of the throttle valve;

wherein the electronic throttle control apparatus is arranged to control an opening angle of the throttle valve by driving the motor so that the actual opening angle detected by the throttle sensor becomes a target opening angle, the electronic throttle control apparatus further includes a fully closing stopper, and an abutting determination unit for determining whether the throttle valve abuts against the fully closing stopper, and the abutting determination unit is arranged to determine whether the throttle valve abuts against the fully closing stopper based on a determination condition preset with respect to each one of a plurality of duty ratio ranges.

2. The electronic throttle control apparatus according to claim 1, wherein the determination condition includes that a state of a lowest duty ratio or more in each duty ratio range continues for a predetermined duration of time.

3. The electronic throttle control apparatus according to claim 1, wherein the abutting determination unit determines that the throttle valve abuts against the fully closing stopper when any one of the determination conditions preset with respect to each of the duty ratio ranges is satisfied.

4. The electronic throttle control apparatus according to claim 1, wherein the abutting determination unit determines whether the throttle valve abuts against the fully closing stopper only when an electric current that flows in the motor is larger than a predetermined value.

5. The electronic throttle control apparatus according to claim 1, wherein the abutting determination unit changes the determination condition set with respect to each of the duty ratio ranges depending on battery voltage to another determination condition.

6. The electronic throttle control apparatus according to claim 1 further including components for transmitting a driving force of the motor to the throttle valve, at least one of the components being made of resin.

7. An electronic throttle control apparatus including:

a motor;

a throttle valve which is driven by the motor to open and close;

a throttle sensor for detecting an actual opening angle of the throttle valve;

wherein the electronic throttle control apparatus is arranged to drive the motor to control so that an opening angle of the throttle valve detected by the throttle sensor based on a learned control reference opening angle becomes a target opening angle, the apparatus further includes:

a fully closing stopper, an abutting determination unit for determining whether the throttle valve abuts against the fully closing stopper, and a lower limit updating unit for updating a control opening lower limit of the throttle valve based on a determination result of the abutting determination unit, and the lower limit updating unit updates the control opening lower limit to the target opening angle when the abutting determination unit determines that the throttle valve does not abut against the fully closing stopper, while the lower limit updating unit updates the control opening lower limit to an opening angle detected by the throttle sensor when the abutting determination unit determines that the throttle valve abuts against the fully closing stopper.

8. The electronic throttle control apparatus according to claim 7, further including an opening angle comparing unit for making a comparison as to which is larger between the control opening lower limit and the target opening when the abutting determination unit determines that the throttle valve does not abut against the fully closing stopper, and wherein the lower limit updating unit updates the control opening lower limit when the opening comparing unit determines that the target opening is smaller than the control opening lower limit.

9. The electronic throttle control apparatus according to claim 8, wherein the lower limit updating unit updates the control opening lower limit by gradually changing it at a predetermined rate.

10. The electronic throttle control apparatus according to claim 7, further includes an opening angle difference determination unit for determining, when the abutting determination unit determines that the throttle valve abuts against the fully closing stopper, whether an opening angle difference between an opening angle of the throttle valve when abuts against the fully closing stopper and the control reference opening angle is a predetermined opening angle or less, and wherein the lower limit updating unit updates the control opening lower limit when the opening angle difference determination unit determines that the opening angle difference is a predetermined value or less.

* * * * *